US011046544B2

(12) United States Patent
Irizarry et al.

(10) Patent No.: US 11,046,544 B2
(45) Date of Patent: Jun. 29, 2021

(54) SYSTEM FOR PREVENTING PAPER JAMS BETWEEN SUBSYSTEM TRANSITIONS

(71) Applicant: XEROX CORPORATION, Norwalk, CT (US)

(72) Inventors: Roberto A Irizarry, Rochester, NY (US); Glenn Batchelor, Fairport, NY (US); Rachel Lynn Tanchak, Rochester, NY (US); Ali R Dergham, Fairport, NY (US); Erwin Ruiz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 223 days.

(21) Appl. No.: 16/391,422

(22) Filed: Apr. 23, 2019

(65) Prior Publication Data

US 2020/0339373 A1 Oct. 29, 2020

(51) Int. Cl.

| | |
|---|---|
| ***B65H 29/24*** | (2006.01) |
| ***B65H 29/12*** | (2006.01) |
| ***B65H 29/70*** | (2006.01) |
| ***B65H 5/06*** | (2006.01) |
| ***B65H 5/36*** | (2006.01) |
| ***B65H 5/22*** | (2006.01) |
| ***B65H 7/20*** | (2006.01) |

(52) U.S. Cl.

CPC ..... *B65H 29/248* (2013.01); *B65H 5/062* (2013.01); *B65H 5/228* (2013.01); *B65H 5/36* (2013.01); *B65H 7/20* (2013.01); *B65H 29/125* (2013.01); *B65H 29/70* (2013.01); *B65H 2301/51256* (2013.01); *B65H 2406/111* (2013.01); *B65H 2406/1132* (2013.01); *B65H 2406/122* (2013.01)

(58) Field of Classification Search

CPC . B65H 5/06; B65H 5/062; B65H 5/22; B65H 5/228; B65H 5/36; B65H 5/38; B65H 7/04; B65H 7/20; B65H 29/248; B65H 2301/447; B65H 2301/51256; B65H 2406/10; B65H 2406/11; B65H 2406/111; B65H 2406/1132; B65H 2406/12; B65H 2406/122

See application file for complete search history.

(56) References Cited

U.S. PATENT DOCUMENTS

| | | | | |
|---|---|---|---|---|
| 4,494,948 | A * | 1/1985 | Teyssier, Jr. ..... | B65H 45/1015 226/196.1 |
| 6,305,772 | B1 * | 10/2001 | Berkoben ..... | B41J 2/16552 347/34 |
| 8,794,624 | B2 | 8/2014 | Herrmann | |
| 9,120,634 | B1 * | 9/2015 | Muir ..... | B65H 5/066 |
| 10,370,212 | B1 * | 8/2019 | Atwood ..... | B65H 9/166 |

(Continued)

*Primary Examiner* — Prasad V Gokhale
(74) *Attorney, Agent, or Firm* — William A. Henry, II

(57) ABSTRACT

An apparatus for controlling cross curl in corners of sheets between in-line transports includes a curved baffle placed between the two transports. A thin layer of high velocity air is applied to the curved baffle only at lead edge corner regions of the sheets. The high velocity air layer, which will have a tendency to follow the curved baffle (Coanda effect), will divert corners of the sheets (Bernoulli effect) towards the curved baffle. By positioning a curved baffle between the two transports and by applying a uniform air stream to it, a lower pressure area will be created. This will flatten the corners of the sheets and ensure passage between downstream baffles and acquisition by a downstream transport.

13 Claims, 4 Drawing Sheets

(56) References Cited

U.S. PATENT DOCUMENTS

| | | | | |
|---|---|---|---|---|
| 2012/0200030 | A1* | 8/2012 | Ruiz | B65H 5/066 271/276 |
| 2015/0239690 | A1* | 8/2015 | Muir | B65H 29/245 271/3.19 |
| 2016/0152045 | A1* | 6/2016 | La Vos | B65H 29/242 347/104 |
| 2017/0090383 | A1* | 3/2017 | Tanaka | G03G 15/6529 |

* cited by examiner

SYSTEM FOR PREVENTING PAPER JAMS BETWEEN SUBSYSTEM TRANSITIONS

CROSS REFERENCE TO RELATED APPLICATIONS

Cross-referenced is commonly assigned U.S. application Ser. No. 16/391,418, filed Apr. 23, 2019, and entitled APPARATUS FOR CONTROLLING SHEET FLATNESS UNDER AN IMAGING SYSTEM ROBUST TO MEDIA CURL by Rachel L. Tanchak et al.; U.S. application Ser. No. 16/391,428, filed Apr. 23, 2019, and entitled MEDIA HANDLING BETWEEN MODULES ROBUST TO PAPER CURL by Carlos M. Terrero et al., both of which are included in their entirety herein by reference.

BACKGROUND

The present disclosure relates to an apparatus for removing process curl during paper path transport between adjacent paper path transports, and more particularly, to an apparatus and method for conveying media or sheet material between adjacent sheet transports that prevents sheet material jamming and dog ears forming on the media or sheet material during transit.

Currently, there is an urgent need in imaging systems for a media handling system that controls curl between transitions where a sheet is unsupported in different areas of the imaging systems. Subsystem baffle entrance gaps are typically between 3-5 mm, but curl on the sheets could be two to three times as high as the baffle entrance to the subsystem.

Sheets are typically transported by drive rollers and idlers and are only constrained in nip contact regions, leaving their inboard and outboard edges unsupported. The unsupported area allows curl on the sheets to catch on the entrance of a following subsystem or not allow for acquisition by a belt of the following subsystem. For example, dog ears or excessive lead edge corner folds can be formed by the lead edge of the sheets catching on baffles or narrow entrances of subsystems creating a fold. Jams are also created at sheet stackers due to the leading edges of sheets catching on narrow baffles and inverter and gravity gates.

With respect specifically to inkjet production printing, there is an issue with sheets lifting between the marker transport and dryer module. This is currently managed with baffles that lead to image defects from the baffles contacting a wet image, and jams due to curl obstruction or contamination of the baffles with ink that has not dried.

Sheet curl dysfunction is created by several noises such as humidity, ink placement, toner amount, grain direction, etc. Curl is one of the primary causes of jams in inkjet systems and ultra-light weight media transports.

In ultra-light weight applications and low media stiffness also causes issues with maintaining optimized sheet trajectory between baffles, underneath scanners and paper-path gates.

Attempts at mitigating some of these issues are not sufficient. For example, current decurler technology only addresses process direction curl. Furthermore, the decurler in most paper paths is located on the output module, therefore, it does not address curl further upstream. Increasing baffle entrance gaps have been tried also, however, if the baffle entrance gaps are designed to be over 10-15 mm sheets run the risk of rolling onto themselves causing jams. A pneumatic baffle is shown in U.S. Pat. No. 8,794,624 that selectively directs cut sheet media in a media feed system.

Therefore, there is a need for an improvement in managing sheet curl in xerographic and inkjet imaging systems.

SUMMARY

Accordingly, in answer to this need, a solution is disclosed that includes placing a curved baffle between adjacent paper path transports and applying a thin layer of high velocity uniform or localized air flow over the curved baffle's surface to control the leading edge of a sheet thereby preventing jams and dog ears. The thin layer of high velocity uniform or localized air flow over the curved surface of the baffle will have a tendency to follow the curved baffle (Coanda effect) and divert the sheet (Bernoulli effect) towards the baffle. By positioning a curved baffle along the media path and by applying a high velocity uniform air stream to it, a lower press area will be created. This will flatten the sheet's trajectory so that the sheet will be reliably received by a downstream acquisition zone of either a vacuum or electrostatic transport.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
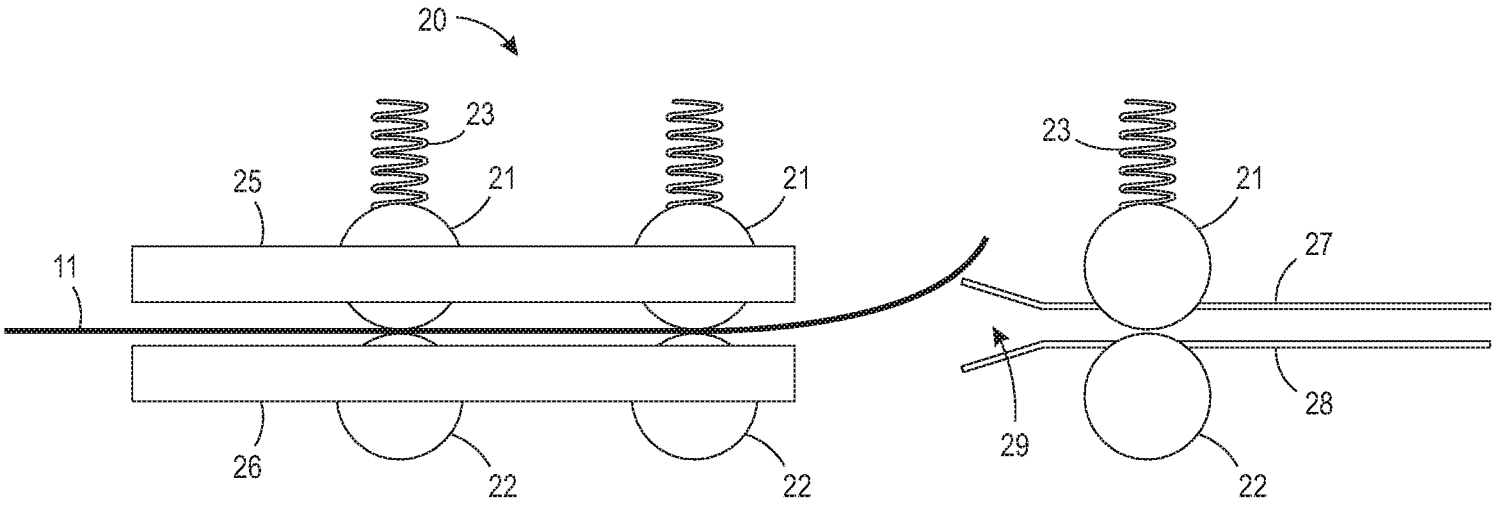
FIG. 1 is a partial side view of a first transport conveying a sheet with up-curl into a baffle gap leading into a downstream second transport with entry of the sheet negated by up-curl in the sheet.

For a general understanding of the features of the disclosure, reference is made to the drawings. In the drawings, like reference numerals have been used throughout to identify identical elements.

FIG. 1 shows a partial side view of a media handling system 20 that includes a media transport which employs a first transport using drive rolls 22 forming nips with idler rolls 21 biased against the drive rolls with spring 23 to convey sheet 11 with cross curl between upper baffle 25 and lower baffle 26 into a baffle gap 29 leading into a nip formed between idler roll 21 and drive roll 22 of a downstream second transport with entry between upper baffle 27 and lower baffle 28 of the second sheet transport being negated by the cross curl in sheet 11. A jam is created at gap 29 due to the cross curl of sheet 11 hitting upper baffle 27 of the second transport.

Figure 2:
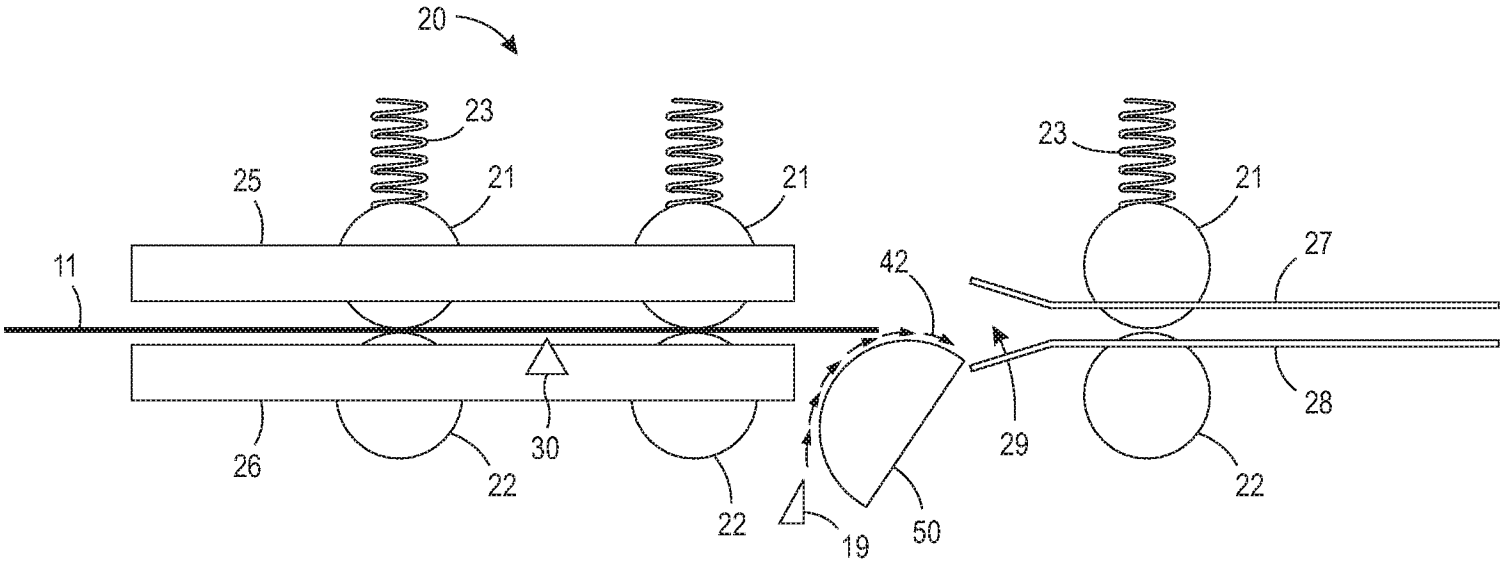
FIG. 2 is a partial side view of the two transport system of FIG. 1 including an air knife and curved baffle in accordance with an aspect to the present disclosure.

In FIG. 2, sheet 11 is shown constrained in its unsupported length by flattening up-curl across its unsupported length during critical transition between first and second transports in accordance with an aspect of the present disclosure by positioning a curved or semi-circular baffle 50 in the media path before baffle gap 29 at the entrance to the second transport. A uniform or localized stream of air is applied by nozzle or air jet 19 in the direction of arrows 42 to curved baffle 50 with the air stream following the surface of the curved baffle (Coanda effect). With air jet regions shown in FIG. 3, air streams are localized on inboard and outboard edges of sheet 11 to flatten the excessive curl areas of the sheet as it travels over curved baffle 50. This critical location and surface will create a lower pressure band (Bernoulli effect), which will flatten the cross curl on the sheet before entering narrow gap 29 of the second transport. A media presence sensor 30 is positioned between drive rolls 22 of the first transport and, if desired, can be used to initiate an air stream from nozzle 19 and cut off the air stream once a sheet gets through the narrow gap 29 and is acquired by the downstream nips formed between idler rolls 21 and drive rolls 22 of the second transport. During the inter-copy gap or at any other time the air stream will not be actuated.

Figure 3:
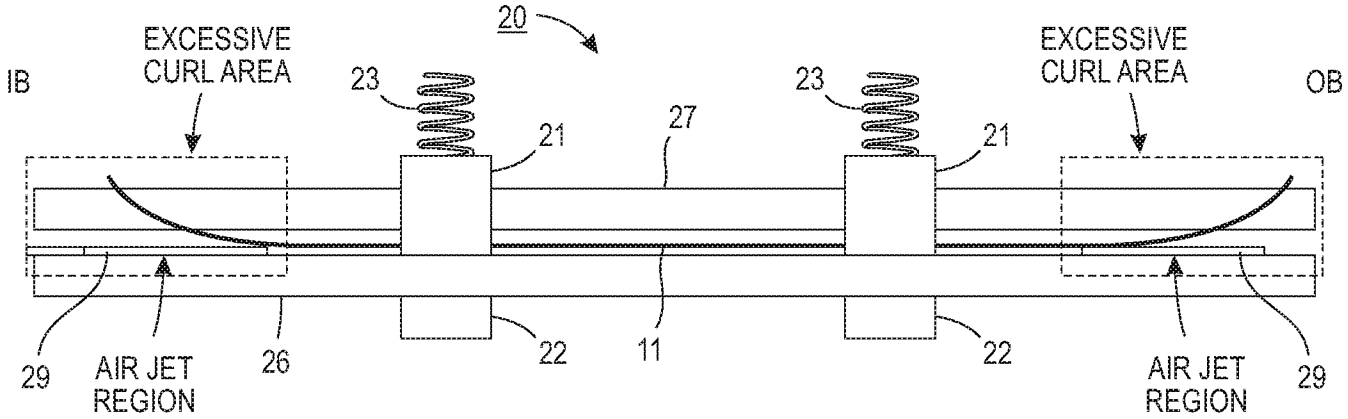
FIG. 3 is a partial end view of the two transport system of FIG. 2 showing a sheet with excessive up-curl contacting a downstream baffle.
Figure 4:
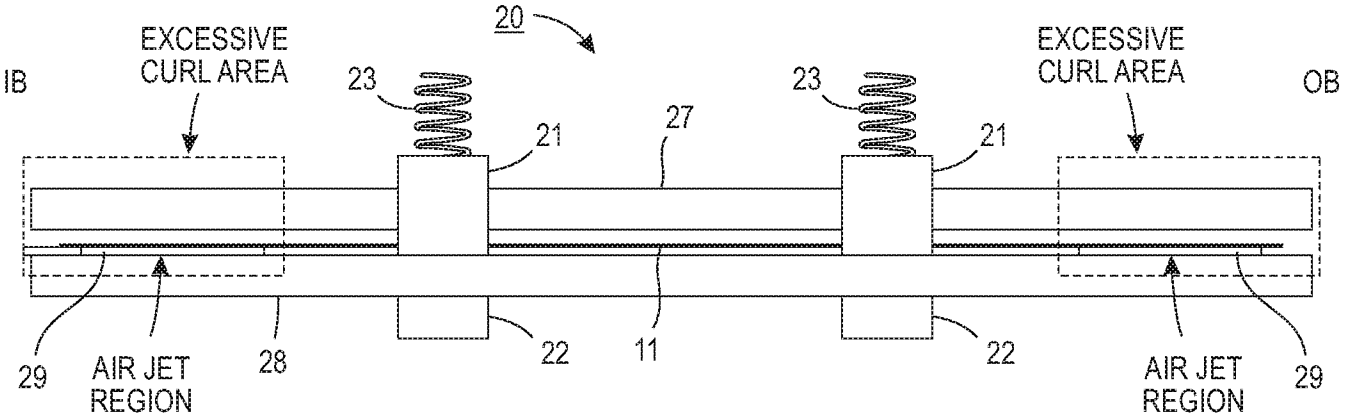
FIG. 4 is a partial end view of the two transport system of FIG. 3 showing the effects of Coanda and Bernoulli principles on the sheet in FIG. 3.

Localized air jet regions 29 are shown in FIGS. 3 and 4 positioned strategically at inboard and outboard edges of sheet 11 with FIG. 3 showing excessive cross curl in sheet 11 extending above baffle 27 of the second transport. In FIG. 4 Coanda and Bernoulli effects on sheet 11 are shown and they combine to flatten the sheet so that it can effectively navigate through gap 29. Uniformed localized air flow over curved baffle 50 in FIG. 2, produces the Coanda effect which causes a thin layer of air to follow the curved baffle with the Bernoulli effect pulling the sheet inboard and outboard edges down to the curved surface and thereby preventing jams and dog ears at the entrance of baffle 27 of the second transport.

In recapitulation, an improved apparatus is disclosed for flattening outboard and inboard edges of media conveyed between two transports. In some instances, depending on the media type, job construction or image, cross curl is observed on the unconstrained edges of the media that will more likely hit the downstream baffle of a transport causing jams and dog eared media. A solution to this concern is disclosed that employs a curved baffle positioned between adjacent paper path transports. Uniformed/localized high velocity air flow is applied over the surface of the curved baffle only in unconstrained areas of the sheet. The high velocity layer of air will follow the curvature of the curved baffle due to the Coanda effect and the media will be diverted (Bernoulli effect) towards the baffle. Introducing the curved baffle between the adjacent transports and applying a uniform high velocity air stream to it will cause a lower pressure area to be created that will flatten unconstrained edges of the media and ensure entry of the media into a downstream transport.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An apparatus for controlling cross curl in sheets conveyed in a paper path between consecutive transports, comprising:

a first transport for conveying sheets to a downstream device;

a second transport downstream of said first transport;

a curved member positioned between said first and second transports;

a series of idler roll and drive roll nips and air jet regions arranged only on outboard and inboard edges of said first transport opposite outside edges of said series of idler roll and drive roll nips;

an air flow device positioned adjacent said curved member; and wherein said air flow device is configured to apply a layer of high velocity air towards only outboard and inboard edges of sheets conveyed through said first transport that follows said curved member to thereby divert said sheets towards said curved member and remove cross curl from leading outboard and inboard edges of said sheets.

2. The apparatus of claim 1, wherein said curved member is a baffle.

3. The apparatus of claim 2, wherein said first and second transports include upper and lower baffles.

4. The apparatus of claim 1, including a sheet presence sensor configured to sense the presence of a sheet at a predetermined position within said first transport.

5. The apparatus of claim 4, wherein said sheet presence sensor is adapted to actuate said air flow device once a sheet within said first transport is sensed.

6. The apparatus of claim 1, wherein said curved member is semi-circular in shape.

7. An arrangement for controlling cross curl in corners of media conveyed in a paper path between in-line transports, comprising:

a first transport for conveying media to a downstream device;

a second transport downstream of said first transport;

a curved member positioned between said first and second transports;

an air flow device including nozzles positioned adjacent said curved member and only at leading edge corners of the conveyed media; and wherein said air flow device is configured to apply a layer of high velocity air that follows said curved member to divert the conveyed media towards said curved member and thereby remove cross curl from leading edges of the conveyed media, and wherein said layer of high velocity air is directed only onto unsupported regions of the conveyed media.

8. The arrangement of claim 7, including a series of idler roll and drive roll nips and air jet regions arranged only on outboard and inboard edges of said first transport opposite outside edges of said series of idler roll and drive roll nips.

9. The apparatus of claim 7, wherein said curved member is semi-circular.

10. A method for controlling cross curl in sheets conveyed between in-line transports in a paper path, comprising:

providing a first transport for conveying sheets in a paper path;

providing a second transport downstream of said first transport;

providing a curved member positioned between said first and second transports;

providing an air flow device positioned adjacent said curved member; and configuring said air flow device to apply a layer of high velocity air towards only outboard and inboard edges of sheets conveyed through said first transport that follows an upper surface of said curved member and thereby divert said sheets towards said curved member and remove cross curl from leading outboard and inboard edges of said sheets.

11. The method of claim 10, including providing a sheet presence sensor configured to sense the presence of a sheet at a predetermined position within said first transport.

12. The method of claim 11, wherein said sheet presence sensor is adapted to actuate said air flow device once a sheet within said first transport is sensed.

13. The method of claim 10, including a series of idler roll and drive roll nips and air jet regions arranged only on outboard and inboard edges of said first transport opposite outside edges of said series of idler roll and drive roll nips.

* * * * *